US007267430B2

(12) United States Patent
Parish

(10) Patent No.: US 7,267,430 B2
(45) Date of Patent: Sep. 11, 2007

(54) HEATER CHIP FOR INKJET PRINTHEAD WITH ELECTROSTATIC DISCHARGE PROTECTION

(75) Inventor: George K. Parish, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 402 days.

(21) Appl. No.: 11/093,144

(22) Filed: Mar. 29, 2005

(65) Prior Publication Data

US 2006/0221141 A1 Oct. 5, 2006

(51) Int. Cl.
*B41J 2/05* (2006.01)

(52) U.S. Cl. ..... 347/59; 347/63; 347/64

(58) Field of Classification Search ..... 347/50, 347/56–59, 63, 65, 67
See application file for complete search history.

(56) References Cited

U.S. PATENT DOCUMENTS

| | | | | |
|---|---|---|---|---|
| 5,187,500 | A | 2/1993 | Bohorquez et al. | 347/57 |
| 5,315,472 | A | 5/1994 | Fong et al. | 347/50 |
| 5,371,395 | A | 12/1994 | Hawkins | 347/59 |
| 5,428,498 | A * | 6/1995 | Hawkins et al. | 347/59 |
| 5,465,189 | A | 11/1995 | Polgreen | 361/58 |
| 5,532,901 | A | 7/1996 | Hawkins et al. | 361/212 |
| 5,710,689 | A | 1/1998 | Becerra | 361/57 |
| 5,719,739 | A | 2/1998 | Horiguchi | 361/220 |
| 5,744,841 | A | 4/1998 | Gilbert | 257/360 |
| 5,870,121 | A * | 2/1999 | Chan | 347/59 |
| 5,960,290 | A | 9/1999 | Hsu | 438/281 |
| 5,988,796 | A | 11/1999 | Yamanaka | 347/58 |
| 6,248,639 | B1 | 6/2001 | Ravanelli | 438/335 |
| 6,361,150 | B1 | 3/2002 | Schulte et al. | 347/56 |
| 6,454,955 | B1 | 9/2002 | Beerling | 347/50 |
| 6,493,198 | B1 | 12/2002 | Arledge | 361/56 |
| 6,567,251 | B1 | 5/2003 | Schulte | 361/56 |
| 6,578,951 | B2 * | 6/2003 | Ozaki et al. | 347/58 |
| 6,692,111 | B2 | 2/2004 | Beerling | 347/58 |

(Continued)

FOREIGN PATENT DOCUMENTS

| | | |
|---|---|---|
| JP | 04-247947 | 9/1992 |

(Continued)

OTHER PUBLICATIONS

Sanjay Dabral, Timothy Maloney, "Grounded-Gate NMOS," Basic ESD and I/O Design, Wiley Interscience Publication / John Wiley & Sons, Inc., pp. 22-23.

*Primary Examiner*—Juanita D. Stephens
(74) *Attorney, Agent, or Firm*—King & Schickli, PLLC

(57) ABSTRACT

An inkjet printhead heater chip includes a resistor layer, a dielectric layer on the resistor layer and a cavitation layer on the dielectric layer. A grounded-gate MOSFET electrically attaches to the cavitation layer to protect the dielectric layer from breakdown during an electrostatic discharge (ESD) event. Protection typically embodies the safe distribution of ESD current to ground during user printhead installation. Locations of the grounded-gate MOSFET(s) include terminal ends of one or more columns of ink ejecting elements formed by the resistor layer. Also, the MOSFET source electrically connects to the gate while the drain attaches to the cavitation layer. The drain attaches via first and second metallization lines, including attachment generally above the cavitation layer. The dielectric layer is diamond like carbon layer and is about 2000 angstroms thick. Inkjet printheads and printers are also disclosed.

20 Claims, 7 Drawing Sheets

U.S. PATENT DOCUMENTS

| | | | | |
|---|---|---|---|---|
| 6,764,892 | B2 | 7/2004 | Kunz | 438/217 |
| 2004/0079744 | A1 | 4/2004 | Bodeau | 219/209 |
| 2004/0100746 | A1 | 5/2004 | Chen | 361/56 |
| 2004/0207693 | A1 | 10/2004 | Sturgeon | 347/58 |
| 2004/0212936 | A1 | 10/2004 | Salling | 361/56 |

FOREIGN PATENT DOCUMENTS

| | | |
|---|---|---|
| JP | 08-132616 | 5/1996 |
| JP | 2003-072076 | 3/2003 |
| JP | 2004-050636 | 2/2004 |

* cited by examiner

HEATER CHIP FOR INKJET PRINTHEAD WITH ELECTROSTATIC DISCHARGE PROTECTION

FIELD OF THE INVENTION

The present invention relates to inkjet printheads. In particular, it relates to a heater chip having electrostatic discharge (ESD) protection. More particularly, it contemplates a grounded-gate MOSFET attached to a cavitation layer above a dielectric and resistor layer and to locations of the MOSFET on the heater chip.

BACKGROUND OF THE INVENTION

The art of printing images with inkjet technology is relatively well known. In general, an image is produced by emitting ink drops from a printhead at precise moments so they impact a print medium at a desired location. The printhead is supported by a movable print carriage within a device, such as an inkjet printer, and is caused to reciprocate relative to an advancing print medium. It emits ink at times pursuant to commands of a microprocessor or other controller. The timing of the emissions corresponds to a pattern of pixels of the image being printed. Other than printers, familiar devices incorporating inkjet technology include fax machines, all-in-ones, photo printers, and graphics plotters, to name a few.

Conventionally, a thermal inkjet printhead includes access to a local or remote supply of color or mono ink, a heater chip, a nozzle or orifice plate attached to or integrated with the heater chip, and an input/output connector, such as a tape automated bond (TAB) circuit, for electrically connecting the heater chip to the printer during use. The heater chip, in turn, typically includes a plurality of thin film resistors or heaters fabricated by deposition, patterning and etching on a substrate such as silicon. One or more ink vias cut or etched through a thickness of the silicon serve to fluidly connect the supply of ink to the individual heaters.

Heretofore, conventional heater chip thin films included a relatively thick silicon nitride (SiN) and silicon carbide (SiC) overlying a resistor layer for reasons relating to passivation. In turn, a cavitation layer overlies the two passivation layers to protect the heater from corrosive ink and bubble collapse occurring in the ink chamber. However, as layers continue to become thinner and more energy efficient over time, thinner passivation seems unable to provide adequate ESD protection. It some instances, the passivation is so thin that ESD events damage the resistor layer making it altogether inoperable.

Accordingly, the inkjet printhead arts desire ESD protection despite a continuing trend toward thinner heater chip configurations.

SUMMARY OF THE INVENTION

The above-mentioned and other problems become solved by applying the principles and teachings associated with the hereinafter described inkjet printhead heater chip having ESD protection.

In one aspect, a heater chip includes a resistor layer, a dielectric layer on the resistor layer and a cavitation layer on the dielectric layer. A grounded-gate MOSFET electrically attaches to the cavitation layer to protect the dielectric layer from breakdown during an electrostatic discharge (ESD) event. Typically, protection embodies the safe distribution of ESD current from the cavitation layer to the MOSFET and to ground during user printhead installation.

In another aspect, a drain of the MOSFET attaches to the cavitation layer via one or more metallization lines. In turn, the metallization lines attach above and on a side of the cavitation layer. The MOSFET source also connects to the gate and both are grounded. Preferred MOSFET conductivities include p-type substrates with n-type drains and sources, whereas the gate is an island of polysilicon that extends away from the substrate in an area between the source and drain. Both light and heavy doping are contemplated. The ground is a bulk material in the substrate and provides an ohmic connection to the source.

In other aspects, the dielectric layer on the resistor layer has a relatively thin layer thickness on the order of about 2000 angstroms. Compositions include diamond like carbon, including various dopants, or more traditional silicon nitride and/or silicon carbide compositions. Other dielectric layers exist on the heater chip and fit between the metallization line connecting the cavitation layer to the MOSFET drain. Compositions of these other layers include spun on glass, silox, PSOG or other.

Locations of the grounded-gate MOSFET include terminal ends of a column of a plurality of ink ejecting elements formed by the resistor layer. Second, third, fourth or more grounded-gate MOSFETs are also contemplated and optionally exist at terminal ends of other columns of ink ejecting elements. In one instance, two grounded-gate MOSFETs reside at terminal ends of two columns of ink ejecting elements on one side of the heater chip while two other grounded-gate MOSFETs reside at the other terminal ends of the two columns on an opposite side of the heater chip. Other instances contemplate two MOSFETs on a same or opposite side of the heater chip.

In still another aspect of the invention, inkjet printheads containing the heater chip and printers containing the printhead are disclosed.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The term wafer or substrate used in this specification includes any base semiconductor structure such as silicon-on-sapphire (SOS) technology, silicon-on-insulator (SOI) technology, thin film transistor (TFT) technology, doped and undoped semiconductors, epitaxial layers of silicon supported by a base semiconductor structure, as well as other semiconductor structures well known to one skilled in the art. The following detailed description is, therefore, not to be taken in a limiting sense, and the scope of the present invention is defined only by the appended claims and their equivalents. In accordance with the present invention, an inkjet printhead heater chip having ESD protection, including a grounded-gate MOSFET, is hereinafter described.

Figure 1:
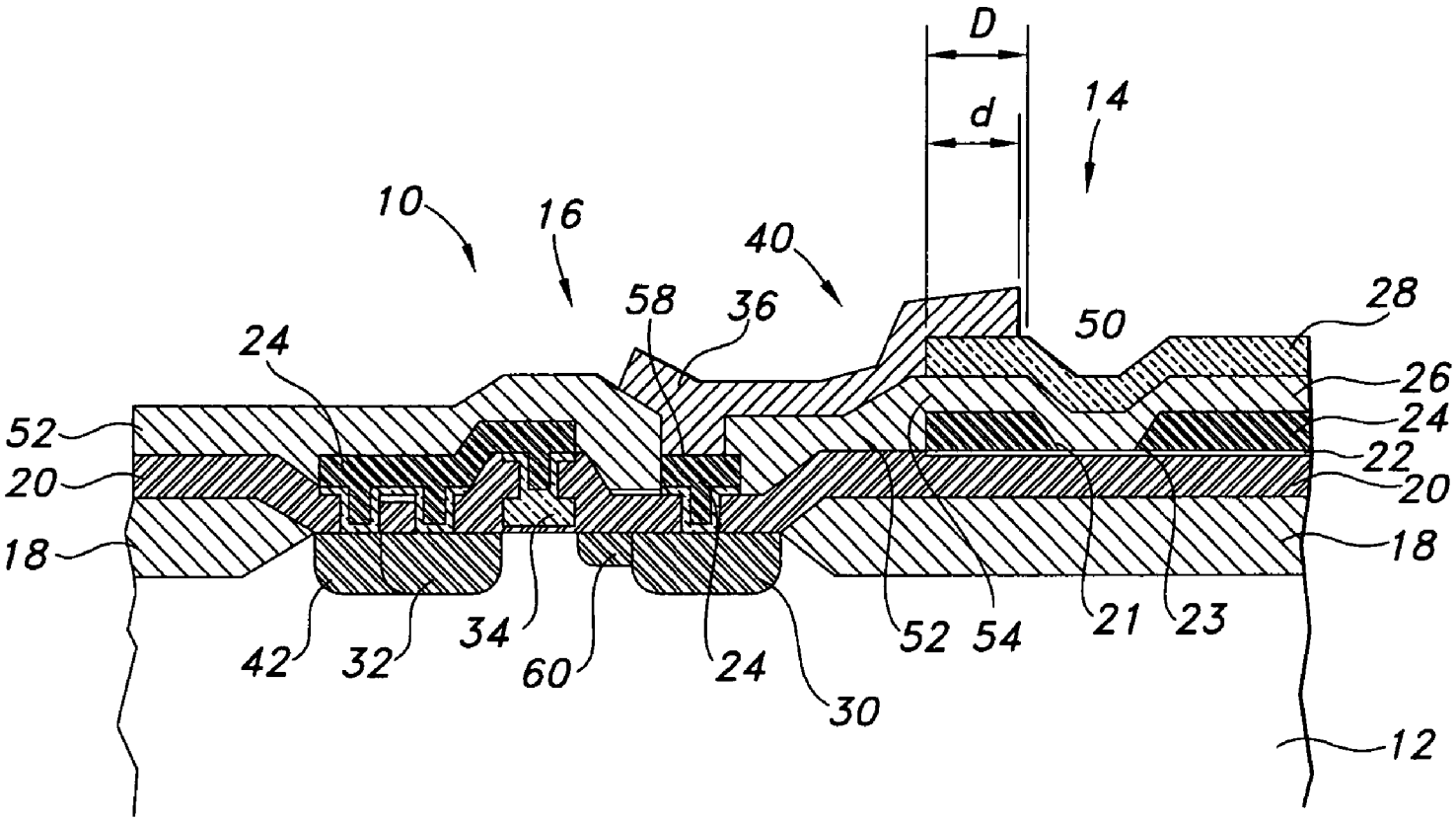
FIG. 1 is a diagrammatic view in accordance with the teachings of the present invention of an inkjet printhead heater chip having a grounded-gate MOSFET providing ESD protection.

With reference to FIG. 1, the heater chip is shown generally as element 10 and is formed as a plurality of thin film layers on a substrate 12. Appreciating the heater chip has been processed through a series of growth layers, deposition, masking, patterning, photolithography, and/or etching or other processing steps, a resulting heater chip includes an ink ejecting element or heater 14 and a grounded-gate MOSFET 16 embodied as a multiplicity of thin film layers stacked upon one another.

Specifically, the thin film layers in the region of the heater include, but are not limited to: a field oxide layer 18, a barrier layer 20; a resistor layer 22; a conductor layer 24 (bifurcated into positive and negative electrode sections, i.e., anodes and cathodes); a dielectric layer 26; and a cavitation layer 28. In the region of the MOSFET, a drain 30, a source 32 and a gate 34 are provided and the source and gate are electrically connected or tied to one another and both are tied to ground. Namely, the conductor layer 24 attaches to both the gate 34 and source 32 as well as to a bulk material 42 having the same conductivity type as the substrate. In turn, the drain attaches or otherwise connects to the cavitation layer 28 via a conductor shown generally as 40. In one instance, the conductor is a single layer. In other instances, it is two or more metallization lines comprising the conductor layer 24 and an overlying metal layer 36 as shown. In this manner, a grounded-gate MOSFET is attached or connected to the cavitation layer of the heater and protects the dielectric layer 26 from breakdown during ESD events. In a preferred embodiment, the grounded-gate MOSFET provides a safe discharge path for ESD current from the cavitation layer to ground for ESD strikes occurring on the cavitation layer.

With more specificity, the substrate 12 provides the base layer upon which all other layers are formed. In one embodiment, it comprises a silicon wafer of p-type conductivity, 100 orientation, having a resistivity of about 5-20 ohm/cm. Its beginning thickness is preferably, but not necessarily required, any one of 525+/−20 microns, 625+/−20 microns, or 625+/−15 microns with respective wafer diameters of 100+/−0.50 mm, 125+/−0.50 mm, and 150+/−0.50 mm.

The field oxide layer 18 is either a grown or deposited layer on the substrate and has a thickness of about 8000 to about 10,000 angstroms. In one instance, it simply comprises silicon oxide.

The next layer is a barrier layer 20 and general provides thermal protection. Representative embodiments include a silicon oxide layer mixed with a glass or essentially pure glass layers including, but not limited to, BPSG (boron, phosphorous, silicon, glass), PSG (phosphorous, silicon, glass) or PSOG (phosphorous, silicon oxide, glass). An exemplary thickness is about 7800 angstroms and this layer can also be grown or deposited and may be combined with the field oxide layer 18 into an essentially contiguous single layer.

Subsequent to the barrier layer and disposed on a surface thereof is the resistor layer 22 that heats up during use to cause ink to eject from the printhead. Preferably, the resistor layer is a tantalum, aluminum, nitrogen mixture having a thickness of about 800 angstroms. In other embodiments, the resistor layer includes essentially pure or compositions of any of the following: hafnium, Hf, tantalum, Ta, titanium, Ti, tungsten, W, hafnium-diboride, $HfB_2$, Tantalum-nitride, $Ta_2N$, TaAl(N,O), TaAlSi, TaSiC, Ta/TaAl layered resistor, Ti(N,O) and WSi(O). Thicknesses may range to about 1000 angstroms or more.

A conductor layer 24 overlies a portion of the resistor layer 22 (e.g., that portion of the resistor layer excluding the portion between points 21 and 23) and includes an anode and cathode for causing the resistor layer to heat up. To stably eject ink, the Applicant incorporates the teaching of co-owned U.S. Pat. No. 6,834,931, entitled "Heater Chip Configuration for an Inkjet Printhead and Printer." In composition and thickness, the conductor layer is about a 99.5-0.5% aluminum-copper mixture of about 5200 angstroms. In other embodiments, the conductor layer includes pure or compositions of aluminum with 2% copper and aluminum with 4% copper.

On an upper surface portion of the resistor layer 22, as between points 21 and 23, and all along the upper surface of the conductor layer 24, resides a dielectric layer 26 that the grounded-gate MOSFET protects from breakdown during ESD events. In one embodiment, the dielectric layer comprises diamond-like carbon, including or not dopants such as silicon, nitrogen, titanium, tantalum or the like. The layer is essentially uniform in thickness and is about 2000 angstroms. Skilled artisans will appreciate, however, that prior art heater chips often included dielectric layers with thicknesses of 3000 angstroms or more and, because of its relative thickness, did not generally require specialized ESD protection as with layers on the order of 2000 angstroms. Thus, the present invention recognizes the problem and provides a simple, but effective solution.

Above the dielectric layer 26 is the cavitation layer 28 and it generally exists to withstand the corrosive effects of ink or prevent the long-term bubble collapse effects in the area 50 generally above the heater. In a preferred embodiment, the cavitation layer includes a layer of tantalum having a thickness of about 2500 angstroms. In other designs, the cavitation layer includes, undoped diamond-like carbon, pure or doped tantalum, pure or doped titanium or other.

A nozzle plate, not shown, is eventually attached or formed on the foregoing described heater stack to direct ink drops, formed as bubbles in the ink chamber area 50 generally above the heater, onto a print medium during use.

A conductor 40 attaches above the cavitation layer 28 and provides an electrical connection path from the cavitation layer 28 to the drain 30 of the MOSFET. In this manner, a safe ESD current path is provided that protects the dielectric layer 26 from developing a leakage current path during ESD events. In one instance, the conductor is about 10,000 angstroms thick in an area above the cavitation layer and is essentially contiguous from the drain to the cavitation layer. In another instance, the conductor has the same thickness and a first composition, embodied as a first metallization line 36, and a second composition, embodied as a second metallization line, e.g., the conductor layer 24. Naturally, the latter embodiment creates an interface 58 between the two metallization lines during manufacturing but otherwise does not change the electrical connections between the cavitation layer and the MOSFET drain. One reason for the different metallization lines lies in making the processing of depositing layers and etching them easier. In a preferred composition, the first metallization line 36 is aluminum and the second metallization line is one and the same as the conductor layer. Of course, other compositions are possible provided they are electrically conductive. Also, the conductor 40 extends onto an upper surface of the cavitation layer for a minimum distance, d, of about 4 microns. Yet, it preferably does not exceed a maximum distance, D, because otherwise it would likely interfere with area 50 which is generally needed to eject ink from the printhead.

Beneath the conductor 40 lies a second dielectric 52 having a composition other than the composition of the dielectric layer 26 that exists above the resistor layer 22. In one design, it embodies silicon oxide. In another, it embodies spun on glass, such as PSOG. In either, its thickness is about 8000 to about 9000 angstroms and abuts the dielectric layer 26 in a region 54 where the heater 14 generally ends. Also, it extends generally above and beyond the grounded-gate MOSFET 16 as shown.

Figure 9:
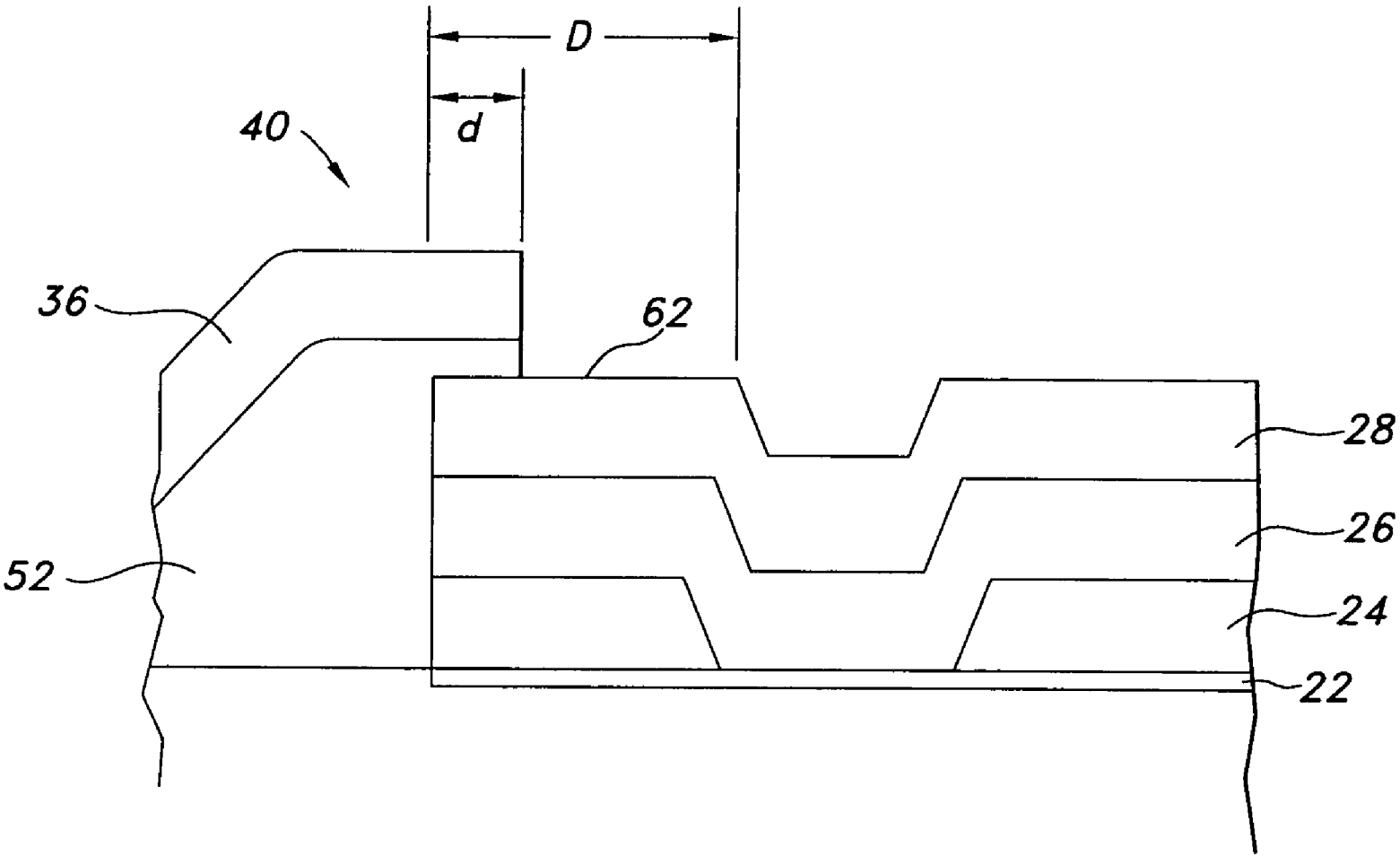
FIG. 9 is a diagrammatic view in accordance with the teachings of the present invention of an alternate embodiment of an inkjet printhead heater chip having a grounded-gate MOSFET providing ESD protection.

In an alternate embodiment (FIG. 9), the second dielectric 52 may directly attach above the cavitation layer 28 for the requisite minimum distance, d, while the conductor 40 is then displaced from the upper surface 62 of the cavitation layer. Of course, skilled artisans will recognize that other designs can also be included in the invention and still provide ESD protection to the dielectric layer 26 during ESD events.

Referring back to FIG. 1, to construct a preferred MOSFET 16, both the drain 30 and source 32 include an n-type dopant in the substrate. In one instance, it especially includes phosphorous in a relatively heavy concentration. Also, an optional lighter doped region 60 could exist in forming the drain and is well known in the art.

The gate 34 is generally a polysilicon island and extends away from the substrate between the source and drain and its fabrication is also well known. As can be seen, the conductor layer 24 extends to electrically connect the gate and source together and to connect both to the bulk material 42 to electrically ground the gate and source. The bulk material 42 is located in the substrate and generally creates an ohmic connection for the source and the gate to connect to ground. In one embodiment, the bulk material is located touching the source 32, as shown. In other embodiments, the bulk material resides nearby, but physically separate from the source. In still other embodiments, the bulk material comprises a p-type conductivity formed as a boron implant. Of course, other dopants may be used and the doping level may be heavy or light depending upon application.

Although not shown, a thin gate oxide, on the order of about 200 angstroms, may exist between the gate 34 and substrate 12. Also, a silicide, such as titanium silicide, may exist between the conductor layer 24 and the drain 30 to facilitate connection of the conductor 40 to the cavitation layer 28.

Further embodiments of the invention contemplate the thin film layers becoming deposited on the heater chip by any variety of chemical vapor depositions (CVD), physical vapor depositions (PVD), epitaxy, ion beam deposition, evaporation, sputtering or other similarly known techniques. In instances of CVD techniques, preferred embodiments include low pressure (LP), atmospheric pressure (AP), plasma enhanced (PE), high density plasma (HDP) or other. In etching techniques, preferred embodiments include, but are not limited to, any variety of wet or dry etches, reactive ion etches, deep reactive ion etches, etc. Preferred photolithography steps include, but are not limited to, exposure to ultraviolet or x-ray light sources, or other, and photomasking includes photomasking islands and/or photomasking holes. The particular embodiment may vary according to manufacturer preference. In one preferred instance of deposition, after various doping of the substrate, the barrier layer 20, the resistor layer 22 and the electrode layer 24 are deposited on the substrate. Then, a first etch occurs to get the patterning shown. The dielectric layer 26 and cavitation layer 28 are next deposited and etched. The second dielectric 52 is thence deposited and etched so that ultimately the metal layer 36 can be deposited. Naturally, alternate schemes may be used and still fall within the scope of the invention.

Figure 2:
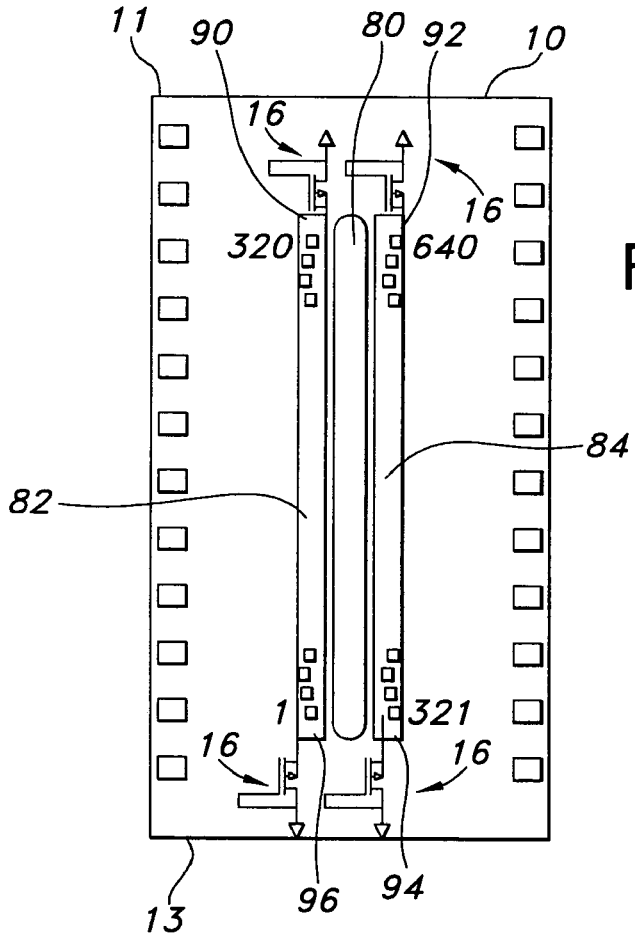
FIGS. 2-5 are diagrammatic views in accordance with the teachings of the present invention for positioning the grounded-gate MOSFET of FIG. 1 on a heater chip.
Figure 3:
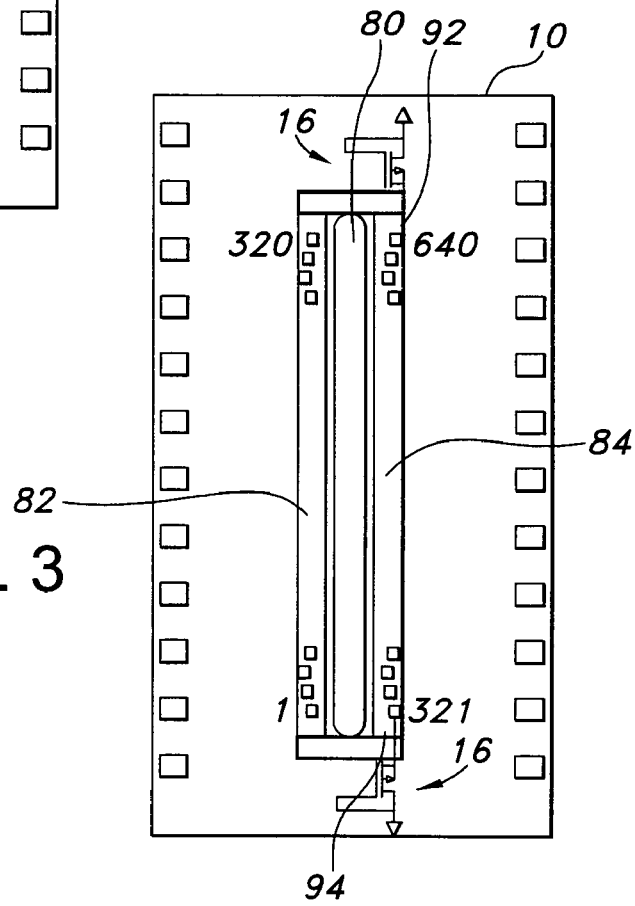

With reference to FIGS. 2-5, the grounded-gate MOSFET 16 may be located at a variety of places on the heater chip 10 and in some instances may include more than one such MOSFET. In FIG. 2, for example, a heater chip 10 includes an ink via 80 surrounded by two columns 82, 84 of a plurality of ink ejecting elements or heaters (formed with the resistor layer) and having heater numbers 1 to 320 on a left of the via and 321 to 640 on the right. Naturally, because of space constraints, only a few of the heaters are shown and are represented by squares in the figure. At a terminal end 90, 92, 94, and 96 of each of the columns 82, 84 is one grounded-gate MOSFET 16 adjacent the last heater to provide ESD protection during ESD events. As shown, the MOSFETs also exist two per each side 11 and 13 of the heater chip to create a substantially balanced design. Conversely, FIG. 4 only shows two grounded-gate MOSFETs that reside one per each end 11, 13 of the heater chip along terminal ends 92, 94 of the rightmost column of ink ejecting elements or heaters. Alternatively, the two MOSFETs could be located adjacent the terminal end of the leftmost column 82 of heaters, although this is not shown. In either design, the MOSFET attaches adjacent the terminal heater in the column as is depicted in FIG. 1.

Figure 4:
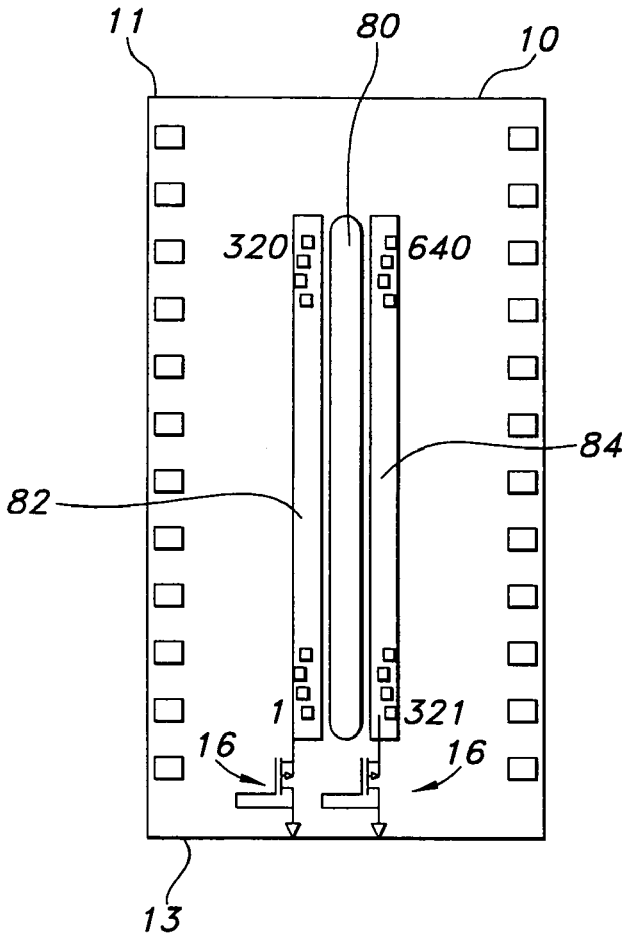
Figure 5:
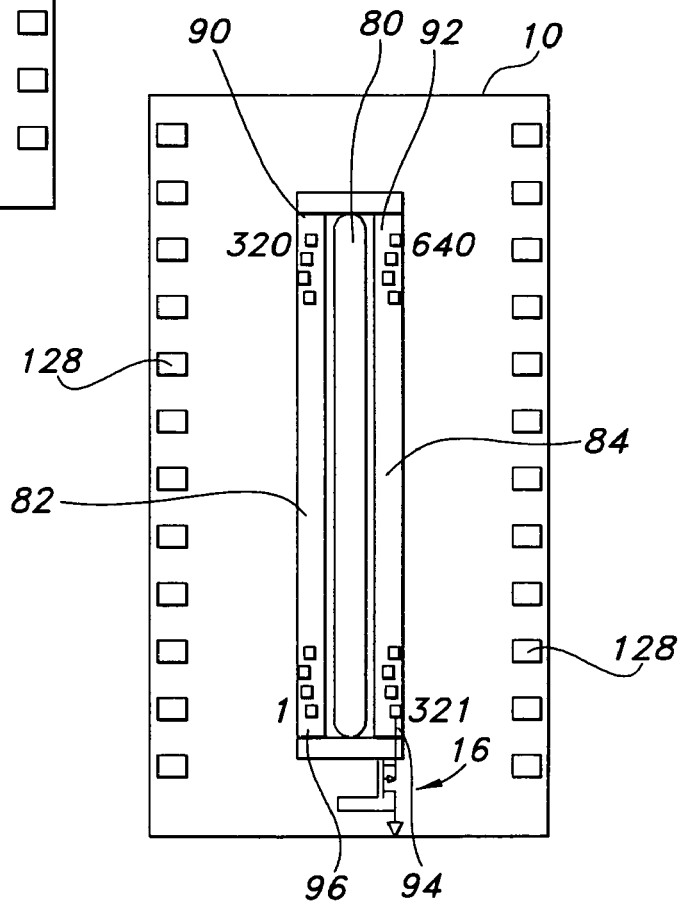

In still other embodiments, the MOSFETs might exist on a same side 13 of the heater chip at terminal ends of both columns 82, 84 of ink ejecting elements as shown in FIG. 4. Alternatively, the two MOSFETs could exist on side 11 instead of side 13. In FIG. 5, only a single MOSFET 16 exists at one terminal end of one of the columns of heaters. Naturally, this single MOSFET could exist at terminal ends 90, 92 or 96 despite just being shown at terminal end 94.

Skilled artisans should appreciate, that although the MOSFET(s) 16 are shown as electrically grounded at terminal ends of the columns of heaters, actual embodiments contemplate a ground buss (not shown) traversing about a periphery of the heater chip and terminating at one or more bond pads 128, representatively shown in FIG. 5.

Figure 6C:
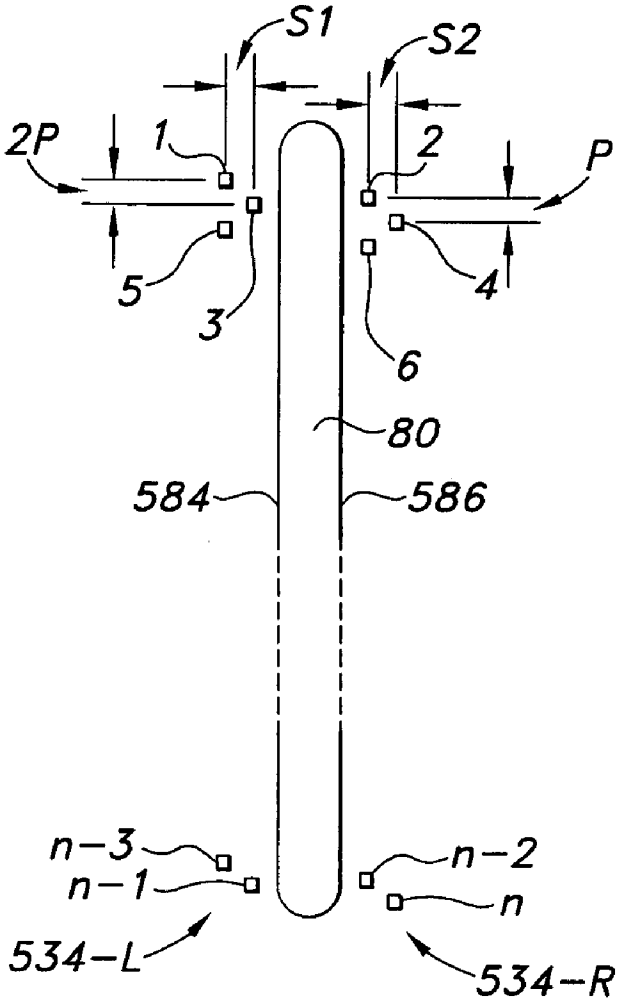
FIGS. 6A-6C are diagrammatic views in accordance with the teachings of the present invention of alternate embodiments of columns of fluid firing elements or ink ejecting heaters.
Figure 6B:
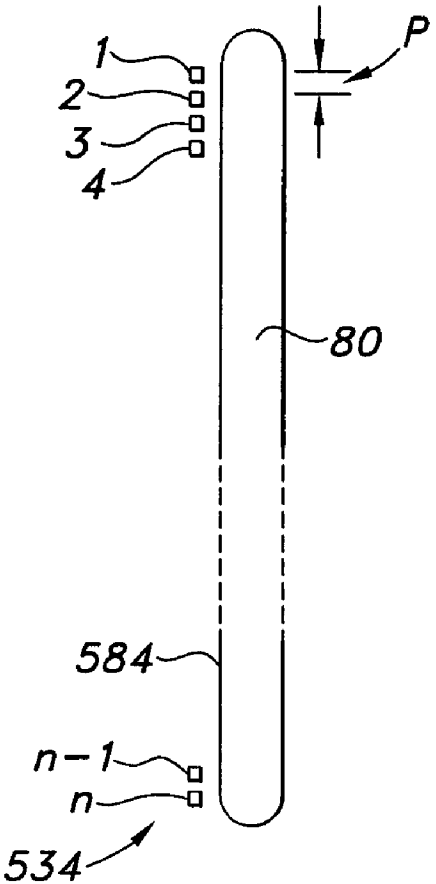
Figure 6A:
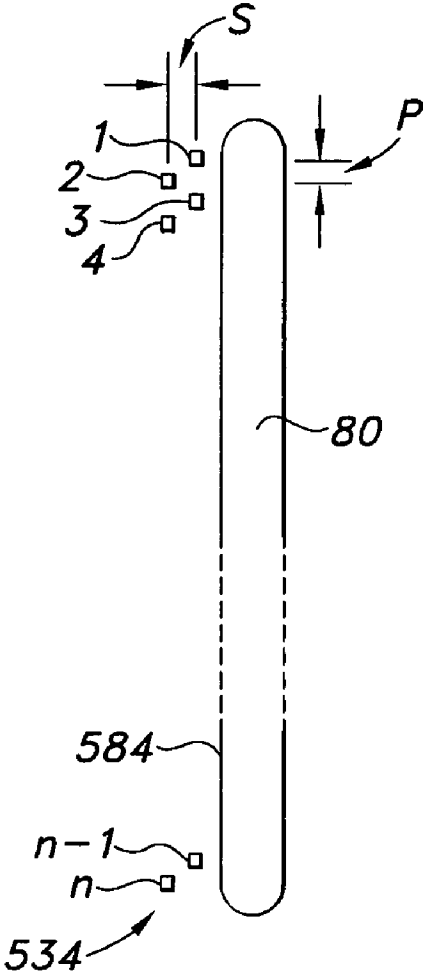

With reference to FIGS. 6A-6C, a column of fluid firing or ink ejecting elements or heaters could have alternate designs and still be embraced within the scope of the invention. For example, FIG. 6A shows the fluid firing elements 1 through n of a given column 534 existing exclusively along one side 584 of an ink via 80. As seen, a slight horizontal spacing gap S exists between vertically adjacent ones of the fluid firing elements and is preferably about $3/1200^{th}$ of an inch. On the other hand, a vertical distance or pitch P exists between vertically adjacent fluid firing elements and generally corresponds to the DPI of the printer in which it is used. Thus, preferred pitches include, but are not limited to, $/1;300^{th}$, $/1;600^{th}$, $/1;1200^{th}$, $/1;2400^{th}$ of an inch.

In FIG. 6B, vertically adjacent ones of fluid firing elements in column 534 are substantially linearly aligned with one another along an entirety of the length of the ink via 80. Although the fluid firing elements of FIGS. 6A, 6B have been shown exclusively on a left side of the via, alternate embodiments of the invention contemplate their location on the right side.

In FIG. 6C, some of the heater chips of the invention may have more than one ink via and more than one column of fluid firing elements and both may be disposed on the same side or on opposite sides of the ink via 80 in columns 534-L and 534-R. In this instance, each column has a spacing gap S1, S2 between vertically adjacent ones of fluid firing elements and both are substantially equal. Also, pitch P may be measured between sequentially numbered fluid firing elements such that a twice pitch 2P vertical spacing exists between sequential odd or even numbered fluid firing elements.

Figure 7:
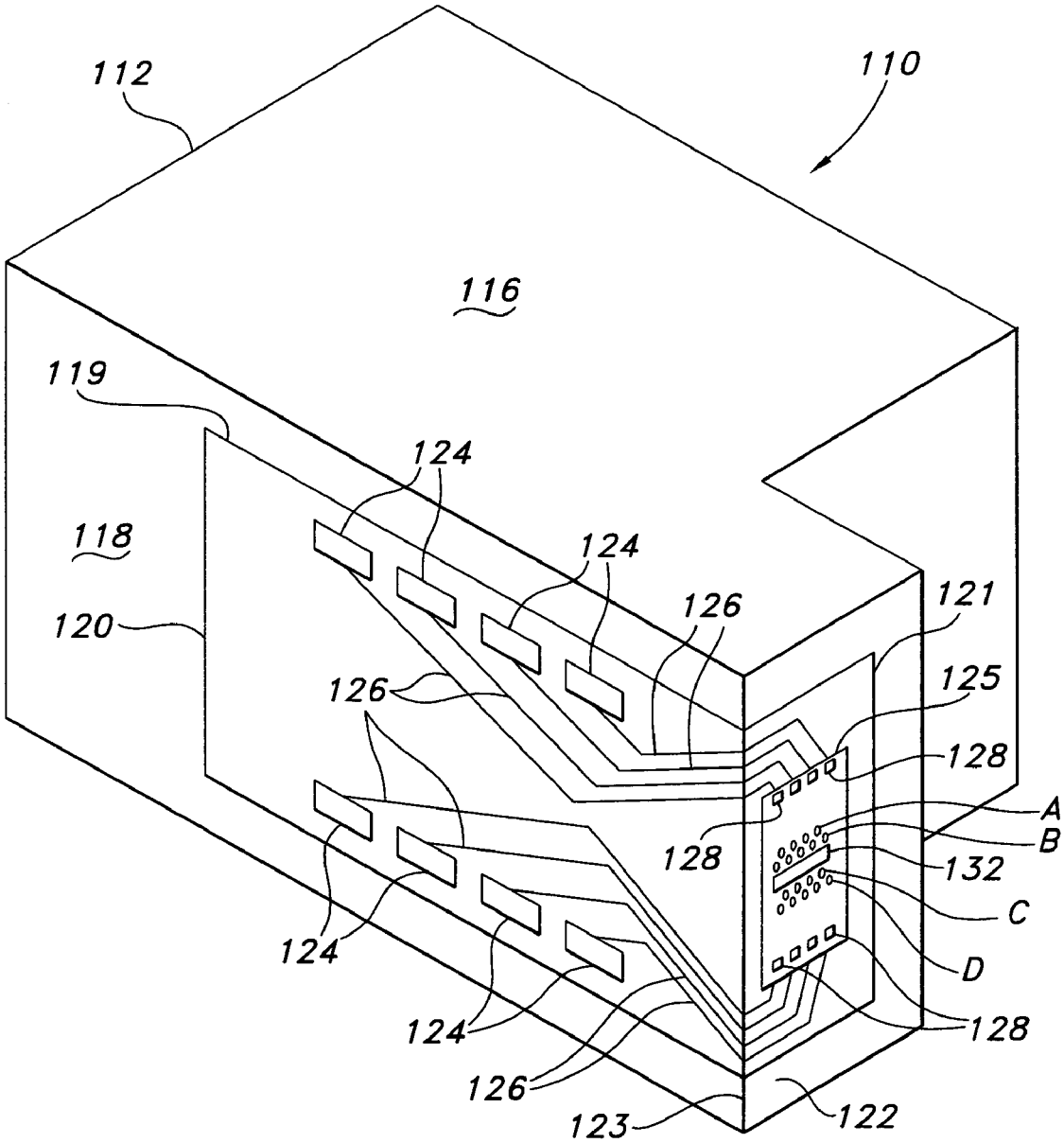
FIG. 7 is a perspective view in accordance with the teachings of the present invention of an inkjet printhead and heater chip containing a grounded-gate MOSFET for providing ESD protection.

With reference to FIG. 7, an inkjet printhead of the present invention is shown generally as 110. The printhead 110 has a housing 112 formed of any suitable material for holding ink. Its shape varies and often depends upon the external device that carries or contains it. The housing has at least one compartment 116 internal thereto for holding an initial or refillable supply of ink. In one embodiment, the compartment has a single chamber and holds a supply of black ink, photo ink, cyan ink, magenta ink or yellow ink. In other embodiments, it has multiple chambers and contains three supplies of ink. In one instance, it includes cyan, magenta and yellow ink. In still other embodiments, the compartment contains plurals of black, photo, cyan, magenta or yellow ink. It will be appreciated, however, that while the compartment 116 is shown as locally integrated within a housing 112 of the printhead, it may alternatively connect to a remote source of ink and receive supply from a tube, for example.

Adhered to one surface 118 of the housing 112 is a portion 119 of a flexible circuit, especially a tape automated bond (TAB) circuit 120. The other portion 121 is adhered to another surface 122 of the housing. In this embodiment, the two surfaces 118, 122 are arranged perpendicularly to one another about an edge 123 of the housing.

The TAB circuit 120 supports a plurality of input/output (I/O) connectors 124 thereon for electrically connecting a heater chip 125 (alternatively reference numeral 10 in FIGS. 1-5) to an external device, such as a printer, fax machine, copier, photo-printer, plotter, all-in-one, etc., during use. Pluralities of electrical conductors 126 exist on the TAB circuit to electrically connect and short the I/O connectors 124 to the input terminals (bond pads 128) of the heater chip 125 and those skilled in the art know various techniques for facilitating such connections. In a preferred embodiment, the TAB circuit is a polyimide material and the electrical conductors and connectors comprise copper. For simplicity, FIG. 7 only shows eight I/O connectors 124, eight electrical conductors 126 and eight bond pads 128 but present day printheads have much larger quantities and any number is equally embraced herein. Still further, those skilled in the art should appreciate that while such number of connectors, conductors and bond pads equal one another, actual printheads may have unequal numbers.

The heater chip 125 contains at least one ink via 132 (alternatively reference numeral 80 in FIGS. 2-6C) that fluidly connects to a supply of ink internal to the housing. During printhead manufacturing, the heater chip 125 preferably connects or attaches to the housing with any of a variety of adhesives, epoxies, etc. well known in the art. To form the vias, many processes are known that cut or etch the via through a thickness of the heater chip. Some of the more preferred processes include grit blasting or etching, such as wet, dry, reactive-ion-etching, deep reactive-ion-etching, or other. As shown, the heater chip contains four columns (column A-column D) of fluid firing elements or heaters. For simplicity in this crowded figure, four columns of six dots or circles depict the heaters but in practice the heaters number several hundred or thousand as shown previously. Vertically adjacent ones of the fluid firing elements may or may not have a lateral spacing gap or stagger there between as shown in FIGS. 6A-6C. In general, however, the fluid firing elements have vertical pitch spacing comparable to the dots-per-inch resolution of an attendant printer. Some examples include spacing of $1/300^{th}$, $1/600^{th}$, $1/1200^{th}$, $1/2400^{th}$ or other of an inch along the longitudinal extent of the via. As described above in greater detail, it is appreciated that the individual heaters of the heater chip preferably become formed as a series of thin film layers made via growth, deposition, masking, patterning, photolithography and/or etching or other processing steps. A nozzle plate with pluralities of nozzle holes, not shown, adheres or is fabricated as another thin film layer such that the nozzle holes align with and above the heaters. During use, the nozzle holes direct the ink towards a print medium.

Figure 8:
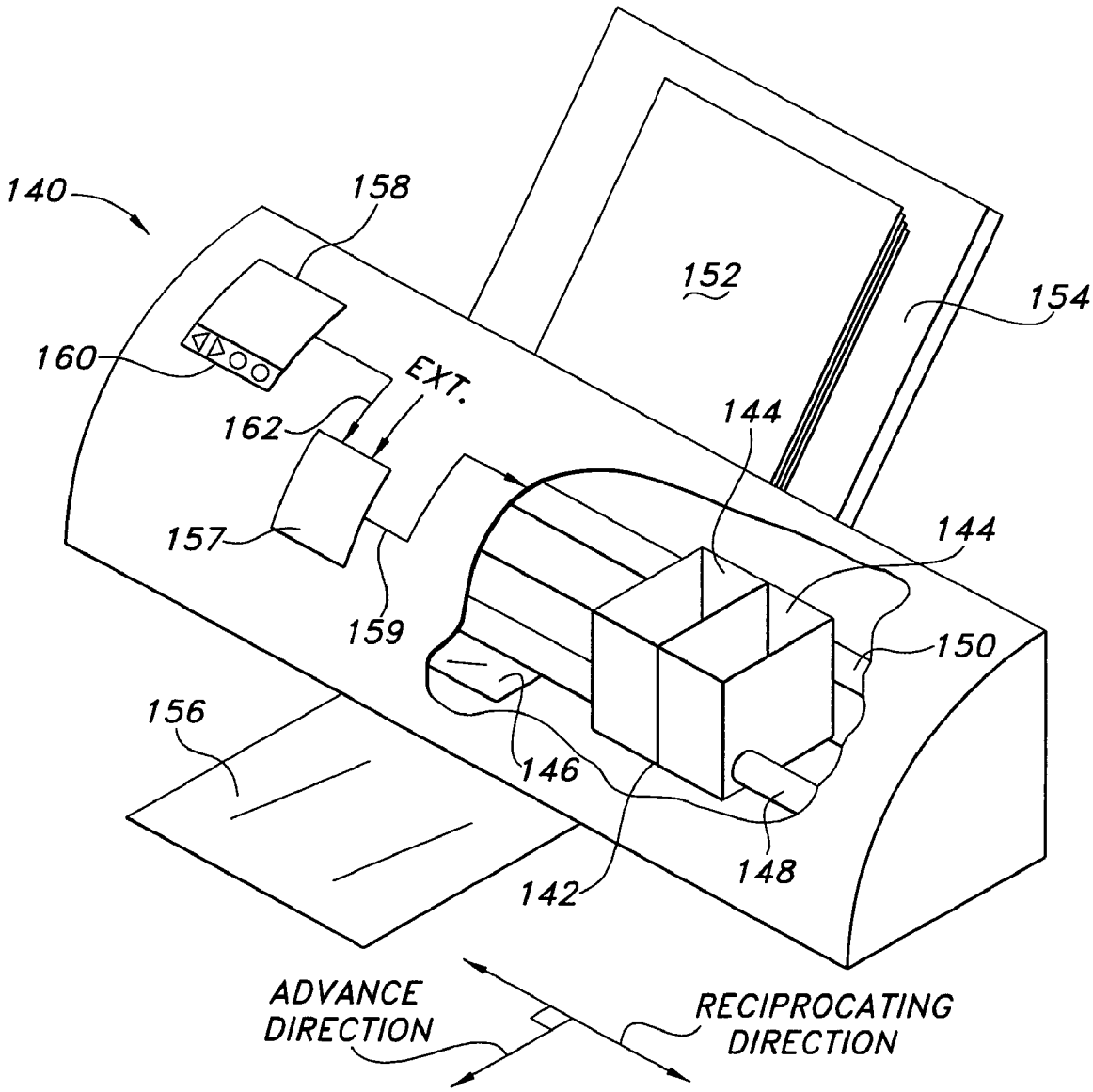
FIG. 8 is a perspective view in accordance with the teachings of the present invention of an exemplary printer for use with the inkjet printhead and heater chip of FIG. 7.

With reference to FIG. 8, an external device in the form of an inkjet printer contains the printhead 110 during use and is shown generally as 140. The printer 140 includes a carriage 142 having a plurality of slots 144 for containing one or more printheads 110. The carriage 142 reciprocates (in accordance with an output 159 of a controller 157) along a shaft 148 above a print zone 146 by a motive force supplied to a drive belt 150 as is well known in the art. The reciprocation of the carriage 142 occurs relative to a print medium, such as a sheet of paper 152 that advances in the printer 140 along a paper path from an input tray 154, through the print zone 146, to an output tray 156.

While in the print zone, the carriage 142 reciprocates in the Reciprocating Direction generally perpendicularly to the paper 152 being advanced in the Advance Direction as shown by the arrows. Ink drops from compartment 116 (FIG. 7) are caused to be eject from the heater chip 125 at such times pursuant to commands of a printer microprocessor or other controller 157. The timing of the ink drop emissions corresponds to a pattern of pixels of the image being printed. Often times, such patterns become generated in devices electrically connected to the controller 157 (via Ext. input) that reside externally to the printer and include, but are not limited to, a computer, a scanner, a camera, a visual display unit, a personal data assistant, or other.

To print or emit a single drop of ink, the fluid firing elements (the dots in columns A-D, FIG. 7) are uniquely addressed with a small amount of current to rapidly heat a small volume of ink. This causes the ink to vaporize in a local ink chamber between the heater and the nozzle plate and eject through the nozzle plate towards the print medium. The fire pulse required to emit such ink drop may embody a single or a split firing pulse and is received at the heater chip on an input terminal (e.g., bond pad 128) from connections between the bond pad 128, the electrical conductors 126, the I/O connectors 124 and controller 157. Internal heater chip wiring conveys the fire pulse from the input terminal to one or many of the fluid firing elements.

A control panel 158, having user selection interface 160, also accompanies many printers as an input 162 to the controller 157 to provide additional printer capabilities and robustness.

Finally, the foregoing description is presented for purposes of illustration and description of the various aspects of the invention. The descriptions are not intended, however, to be exhaustive or to limit the invention to the precise form disclosed. Accordingly, the embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An inkjet printhead heater chip for an inkjet printhead, comprising:

a dielectric layer;

a cavitation layer on the dielectric layer; and a grounded-gate MOSFET connected to the cavitation layer to protect the dielectric layer from breakdown during an ESD event.

2. The inkjet printhead heater chip of claim 1, wherein the dielectric layer is about 2000 angstroms thick.

3. The inkjet printhead heater chip of claim 1, wherein the cavitation layer is directly on the dielectric layer.

4. The inkjet printhead heater chip of claim 1, wherein a conductor attaches the cavitation layer to a drain of the MOSFET.

5. The inkjet printhead heater chip of claim 4, wherein the conductor includes two or more metallization lines.

6. The inkjet printhead heater chip of claim 4, wherein the conductor attaches above the cavitation layer.

7. The inkjet printhead heater chip of claim 1, wherein a source of the MOSFET connects electrically to the gate.

8. The inkjet printhead heater chip of claim 1, wherein the grounded-gate MOSFET exists at a terminal end of a column of ink ejecting heaters.

9. The inkjet printhead heater chip of claim 1, further including a resistor layer under the dielectric layer.

10. The inkjet printhead heater chip of claim 1, wherein the dielectric layer is a diamond like carbon layer.

11. An inkjet printhead heater chip for an inkjet printhead, comprising:

a resistor layer having a plurality of ink ejecting heaters arranged in a column for ejecting ink, a dielectric layer on the resistor layer;

a cavitation layer on the dielectric layer; and a grounded-gate MOSFET located adjacent a terminal end of the column and connected to the cavitation layer to protect the dielectric layer from breakdown during an ESD event.

12. The inkjet printhead heater chip of claim 11, further including a second grounded-gate MOSFET located adjacent a second terminal end of the column.

13. The inkjet printhead heater chip of claim 11, further including a second grounded-gate MOSFET located adjacent a second terminal end of a second column of ink ejecting heaters.

14. The inkjet printhead heater chip of claim 13, wherein the grounded-gate MOSFET and the second grounded-gate MOSFET exist on a same end of the heater chip.

15. The inkjet printhead heater chip of claim 13, further including a third and a fourth grounded-gate MOSFET.

16. The inkjet printhead heater chip of claim 15, wherein the third and the fourth grounded-gate MOSFET exist on an end of the heater chip opposite the same end.

17. An inkjet printhead heater chip for an inkjet printhead, comprising:

a resistor layer having a plurality of ink ejecting heaters arranged in a column for ejecting ink.

a dielectric layer on the resistor layer;

a cavitation layer on the dielectric layer; and a MOSFET located adjacent a terminal end of the column and connected to the cavitation layer to protect the dielectric layer from breakdown during an ESD event, wherein the MOSFET has a drain electrically connected to the cavitation layer with a metallization line and a gate electrically connected to a source, the gate and the source being electrically connect to ground.

18. The inkjet printhead heater chip of claim 17, wherein the metallization line connects to the cavitation layer from above.

19. The inkjet printhead heater chip of claim 17, wherein the dielectric layer is about 2000 angstroms thick and includes diamond like carbon.

20. The inkjet printhead heater chip of claim 17, further including a second MOSFET having a gate electrically connected to a source and to ground, the second MOSFET located adjacent a second terminal end of the column or a second column of ink ejecting heaters.

* * * * *